US005505028A

United States Patent [19]

Giles

[11] Patent Number: 5,505,028

[45] Date of Patent: Apr. 9, 1996

[54] LOG FABRICATING PROCESS AND LOG FOR THE CONSTRUCTION OF LOG STRUCTURES

[75] Inventor: Randy K. Giles, Jefferson County, Tenn.

[73] Assignee: Hearthstone Builders, Inc., Dandridge, Tenn.

[21] Appl. No.: 343,128

[22] Filed: Nov. 22, 1994

[51] Int. Cl.[6] ..... E04B 1/10

[52] U.S. Cl. ..... 52/233; 52/730.7

[58] Field of Search ..... 52/720.1, 233, 52/266, 286, 284, 730.7, 737.3; 403/355, 358, 383

[56] References Cited

U.S. PATENT DOCUMENTS

| | | | |
|---|---|---|---|
| 1,813,455 | 7/1931 | Lawton | 52/233 |
| 1,943,033 | 1/1934 | Midby | 52/233 |
| 2,130,231 | 9/1938 | Forciea | 52/233 |
| 2,289,018 | 7/1942 | Jonsrud | 52/233 |
| 2,416,162 | 12/1943 | Drake | 52/233 |
| 2,463,612 | 3/1949 | Grudda | 52/233 |
| 2,613,708 | 10/1952 | Blackmore | 52/233 |
| 3,527,005 | 9/1970 | Slavens | 52/233 |
| 3,957,095 | 5/1976 | Johnson | 145/5 R |
| 4,047,350 | 9/1977 | Chisum | 52/233 X |
| 4,082,129 | 4/1978 | Morelock | 144/326 |
| 4,143,692 | 3/1979 | Traben | 144/323 |
| 4,167,961 | 9/1979 | Paris, Jr. et al. | 144/3 R |
| 4,168,675 | 9/1979 | Chisum | 118/35 |
| 4,230,163 | 10/1980 | Barton | 144/116 |
| 4,356,678 | 11/1982 | Hauptman | 52/233 X |
| 4,391,067 | 7/1983 | Frady et al. | 52/97 |
| 4,443,990 | 4/1984 | Johnson | 52/233 X |
| 4,509,571 | 4/1985 | Peters | 144/2 R |
| 4,519,429 | 5/1985 | Dreese | 144/3 R |
| 4,527,981 | 7/1985 | Chisum | 434/72 |
| 4,599,837 | 7/1986 | Wrightman | 52/233 |
| 4,742,657 | 5/1988 | Veech | 52/233 |
| 4,871,003 | 10/1989 | Lucas et al. | 144/369 |
| 4,901,489 | 2/1990 | Garber | 52/233 |
| 4,951,435 | 8/1990 | Beckedorf | 52/233 |
| 5,020,289 | 6/1991 | Wrightman | 52/233 |
| 5,253,458 | 10/1993 | Christian | 52/233 |

*Primary Examiner*—Carl D. Friedman
*Assistant Examiner*—David Jersen
*Attorney, Agent, or Firm*—Pitts & Brittian

[57] ABSTRACT

A fabricating process for fabricating a log used in the construction of log structures, and resulting construction log. The process of the present invention includes the steps of cutting a first longitudinal groove (34) in an upper surface (16) of a log having an elongated body (10) defining upper and lower surfaces (16 and 18) and defining varying dimensions between the upper and lower surfaces (16 and 18) of the body (10) along the length of the log. The first longitudinal groove (34) is designed for receiving a portion of a spacing block (38) disposed between logs in a log structure. Further, a second longitudinal groove (36) is cut in the lower surface (18) of the log body (10) for receiving a portion of a spacing block (38), with the first longitudinal groove (34) and the second longitudinal groove (36) defining bottom surfaces (42 and 44) which are substantially parallel to one another.

6 Claims, 4 Drawing Sheets

LOG FABRICATING PROCESS AND LOG FOR THE CONSTRUCTION OF LOG STRUCTURES

TECHNICAL FIELD

This invention relates to a log fabricating process, and the resulting log for the construction of log structures. In accordance with the process of this particular invention grooves are cut in the upper and lower surfaces of a log which varies in vertical dimension along its length between its upper and lower surfaces, the grooves being cut such that they defines lower surfaces which are substantially parallel notwithstanding the varying vertical dimensions of the log. Accordingly, the resulting log defines varying vertical dimensions between the upper and lower surfaces, yet defines dados or grooves of varying depth in the upper and lower surfaces which define bottom surfaces which are substantially parallel.

BACKGROUND ART

Log construction continues to be a popular form of construction for structures such as, for example, homes. However, most of the log structures built in recent years look very little like the early log structures which were constructed of logs which were hand-hewn from the trunks of trees. In this regard, in traditional log construction the tree trunks used for logs underwent minimal modification before incorporation into a structure. Accordingly, the height or vertical dimensions of the logs when disposed horizontally in a log structure varied along their lengths as a consequence of the natural inconsistent diameters of the trees from which the logs were derived. Of course, variations in the vertical dimensions of the logs along their lengths resulted in gaps of varying widths between adjacent logs, and these gaps were filled with a hardenable chinking material such as clay or mud. Thus, in traditional log construction not only did the vertical dimensions of the logs vary along their lengths, but the chinking joints between the logs varied in height along their lengths.

Of course, the variation in the vertical dimension of the logs along their length made construction difficult, and the resulting gaps between the logs, although they could be filled with chinking material, were undesirable. Thus, in recent years, logs used in the construction of log structures have been milled to define a uniform height or vertical dimension along their lengths. Further, rigid spacing blocks are generally disposed between the logs to span uniform gaps between the logs, with a decorative coating of chinking material being provided on exposed surfaces of the spacing blocks to give the appearance of a traditional chinking joint. However, given the uniformly dimensioned logs and uniformly dimensioned gaps therebetween the appearance of the traditional log structure is lost. Examples of known log construction methods and techniques are disclosed in U.S. Pat. Nos. 5,253,458; 5,020,289; 4,951,435; 4,871,003; 4,527,981; 4,519,429; 4,509,571; 4,391,067; 4,230,163; 4,168,675; 4,167,961; 4,143,692; 4,082,129; and 3,957,095.

Therefore, it is an object of the present invention to provide a log and an associated fabricating process for fabricating logs used in the constructions of log structures wherein the resulting log structure gives the appearance of a traditional log structure.

It is another object of the present invention to provide a log for use in the construction of log structures which is easily incorporated into a log structure yet defines a varying vertical dimension along its length, and to provide a fabricating process for fabricating such logs.

Yet another object of the present invention is to provide a fabricating process for fabricating logs used in the constructions of log structures which requires a minimum of labor and which is cost efficient.

DISCLOSURE OF THE INVENTION

Other objects and advantages will be accomplished by the present invention which provides a fabricating process for fabricating logs used in the construction of log structures. The process includes the steps of cutting a first longitudinal groove in an upper surface of a log having an elongated body defining upper and lower surfaces and defining varying dimensions between the upper and lower surfaces of the body along the length of the log. The first longitudinal groove is designed for receiving a portion of a spacing block disposed between logs in a log structure. Further, a second longitudinal groove is cut in the lower surface of the log for receiving a portion of a spacing block, with both the first longitudinal groove and the second longitudinal groove defining bottom surfaces which are substantially parallel to one another. Thus, as a consequence of the varying vertical dimensions between the upper and lower surfaces of the log, the depth of the first and second longitudinal grooves varies along the length of the first and second longitudinal grooves. Accordingly, when the log of the present invention in incorporated into a log structure, the resulting wall structure gives the appearance of traditional log construction wherein the logs are of inconsistent vertical dimension and the chinking joint between the logs varies in height.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
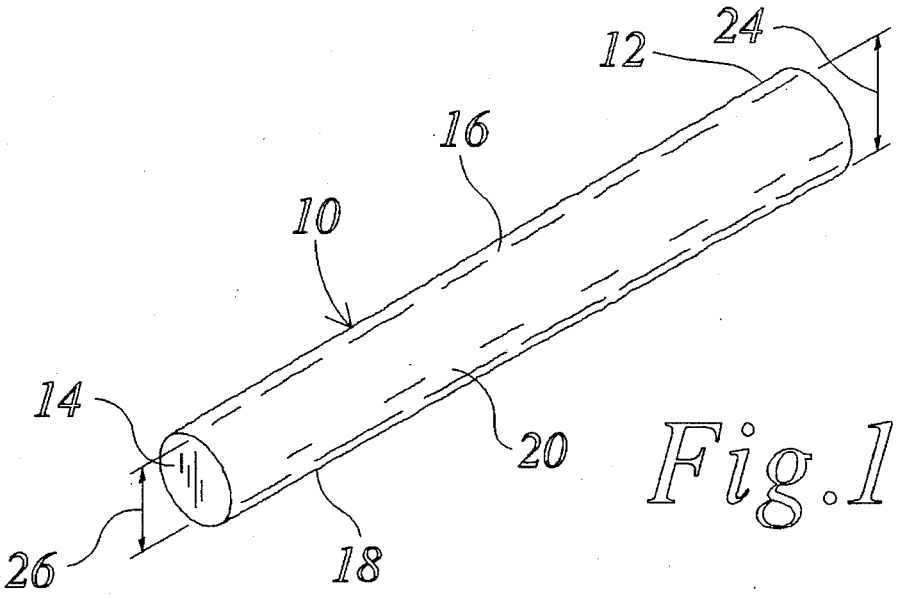
FIG. 1 illustrates a perspective view of an unprocessed log such as that which would be used in the log fabricating process of the present invention.

In FIG. 1, a log which has not yet been milled in accordance with the fabricating process of the present invention is depicted at 10. Typical of such unprocessed logs, the log 10 defines an elongated body which is roughly circular in cross-section, and which defines first and second ends 12 and 14, respectively, upper and lower surfaces 16 and 18, respectively, and opposite sides 20 and 22. Also, the typical unprocessed log generally varies in diameter along its length such that when the log is in substantially horizontal alignment, the vertical dimension of the log between the top and bottom surfaces 16 and 18 varies along its length. For example, the illustrated log 10 gradually narrows from the first end 12 to the second end 14 such that the vertical dimension referenced at 24 at the first end 12 of the log 10 is greater than the vertical dimension referenced at 26 at the second end 14 of the log. Pursuant to the milling process of the present invention this variation in vertical dimension is retained so as to provide the authentic appearance of the resulting log structure, but the log is otherwise configured to accommodate improved construction techniques.

Figure 2:
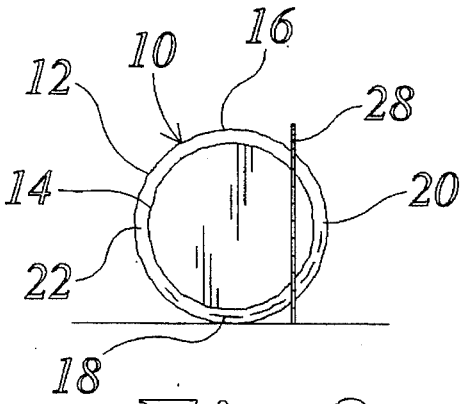
FIG. 2 illustrates an end view of a log during the step of cutting away a selected portion of side of the log in accordance with the log fabricating process of the present invention.
Figure 3:
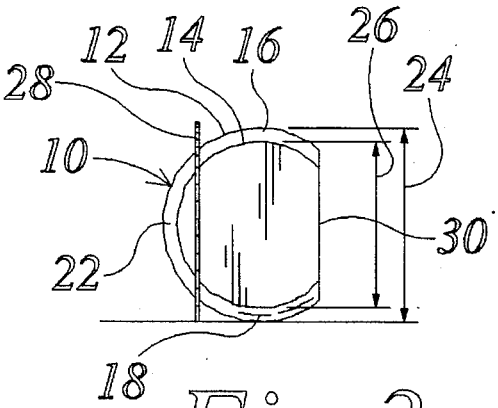
FIG. 3 illustrates an end view of a log during the step of cutting away a selected portion of a further side of the log in accordance with the log fabricating process of the present invention.
Figure 4:
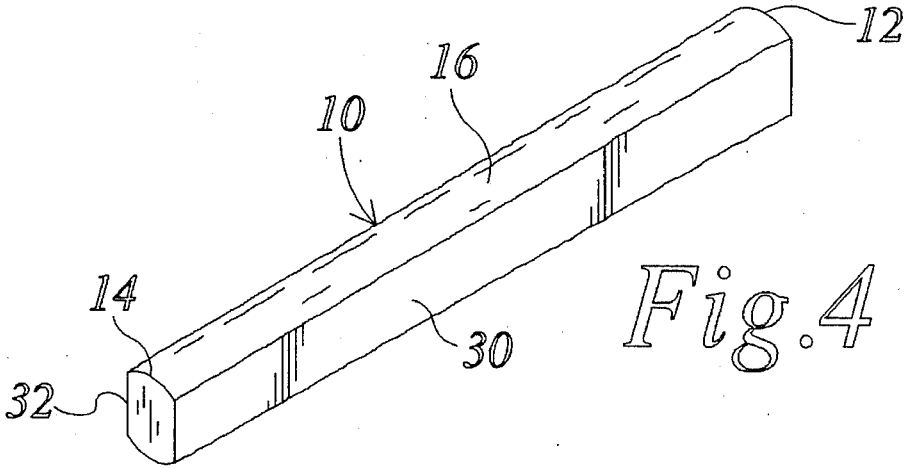
FIG. 4 illustrates a perspective view of a log after selected portions of the opposite sides of the log have been cut away in accordance with the log fabricating process of the present invention.
Figure 5:
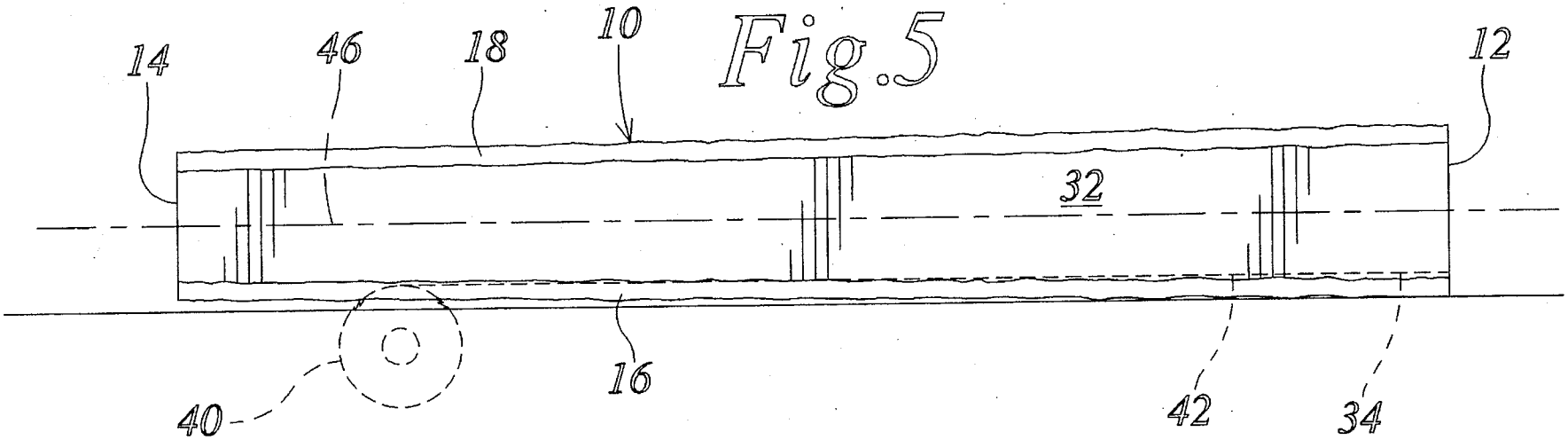
FIG. 5 illustrates a front elevation view of a log during the step of cutting a longitudinal groove in the upper surface of the log in accordance with the log fabricating process of the present invention.
Figure 6:
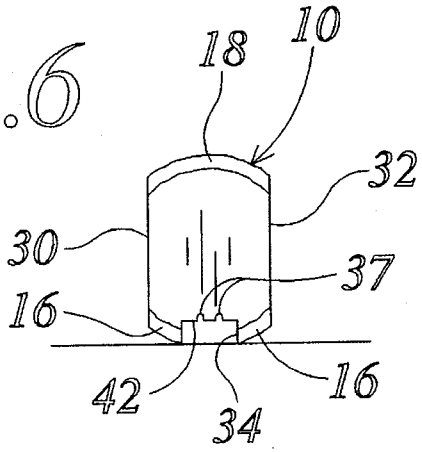
FIG. 6 illustrates an end view of a log after a longitudinal groove has been cut in the upper surface of the log in accordance with the log fabricating process of the present invention.
Figure 7:
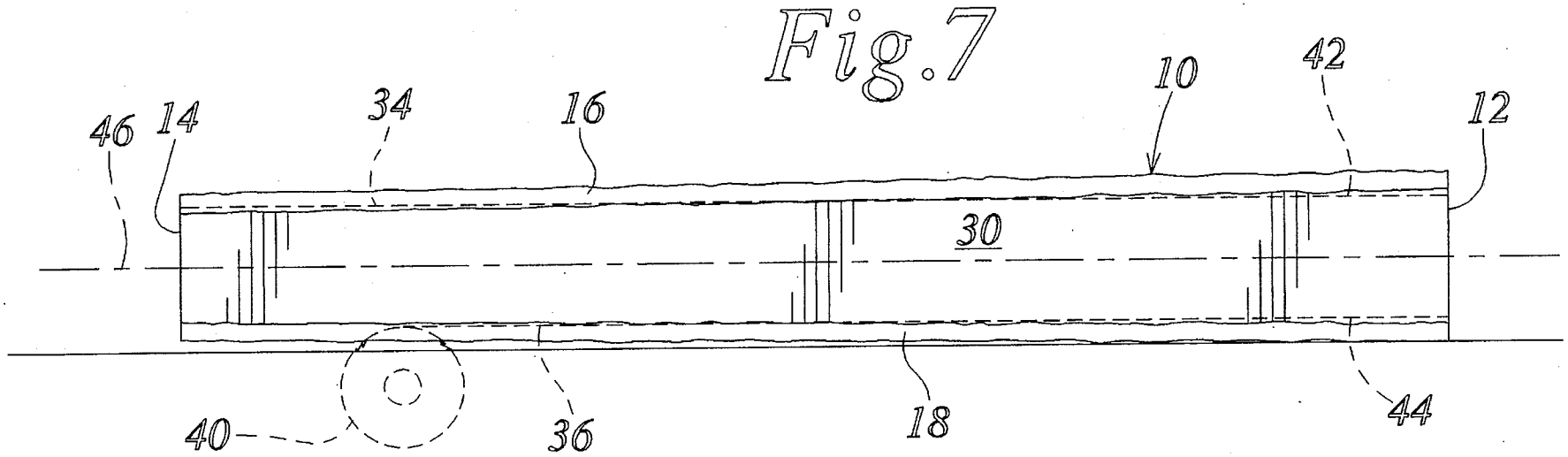
FIG. 7 illustrates a front elevation view of a log during the step of cutting a longitudinal groove in the lower surface of the log in accordance with the log fabricating process of the present invention.

The various steps of the milling process of the present invention are diagrammatically illustrated in FIGS. 2–8. In the preferred application of the milling process, a cutting device, such as the illustrated saw 28, is used to cut away selected portions of the opposite sides 20 and 22 of the log 10, as illustrated in FIGS. 2 and 3, to produce the log 10 illustrated in FIG. 4. In this regard, the log 10 of FIG. 4 defines oppositely disposed, at least roughly planar, wall surfaces 30 and 32 extending along its length. However, the log be still defines the original upper and lower surfaces 16 and 18, respectively, which retain the arcuate, or roughly arcuate, surface of the unmilled log 10. It will be recognized by those skilled in the art that the cutting away of the opposite side portions 20 and 22 of the log 10 can be simultaneously accomplished by moving the log 10 between two selectively space cutting devices, such as, for example, two selectively spaced saw blades.

Further, in the preferred application of the process of the present invention upper and lower longitudinal grooves 34 and 36, respectively, are cut in the upper and lower surfaces 16 and 18, respectively, of the log 10 as illustrated in FIGS. 5–8. Whereas the grooves 34 and 36 are illustrated as extending the full length of the log 10, it will be recognized by those skilled in the art that for certain construction application the grooves may extend along only a portion of the length of the log. As is discussed below with respect to FIGS. 9 and 10, the grooves 34 and 36 are receptive of the spacing blocks 38 which are disposed between the adjacent logs of a log structure.

More specifically, a cutting device, such as the illustrated dado cutter 40, is used (see FIGS. 5 and 7) to cut the grooves 34 and 36 such that the bottom surfaces 42 and 44 of the grooves 34 and 36 are substantially parallel to one another over the length of the log 10. Due to the varying vertical dimensions of the log 10 the resulting grooves 34 and 36 vary in depth along the length in the log 10. For example, with respect to the illustrated log 10 of FIG. 8, the grooves 34 and 36 are deeper at the first end 12 of the log 10 and become shallower toward the second end 14 as the vertical dimension of the log 10 decreases. Typically the depth of the grooves 34 and 36 varies between 0" and 4" along the length of the log 10 but a greater maximum depth can be used if desired. Further, it will be recognized by those skilled in the art that the grooves 34 and 36 can be cut simultaneously by moving the log 10 between two selectively spaced cutting devices, such as, for example, two dado cutters.

In the preferred application of the process of the present invention the grooves 34 and 36 define rectilinear cross-sections with a pair of secondary grooves 37 being provided for receiving tongues provided on the spacing blocks 38, but other groove configurations can be used. For example, the grooves 34 and 36 can be cut such that tongues are defined on the bottom surfaces 42 and 44 for being received in grooves in the blocks 38. Further, the bottom surfaces 42 and 44 are preferably disposed substantially parallel to the longitudinal axis or center line 46 of the log 10 to facilitate proper alignment of the log 10 when incorporated into a log structure.

Thus, it will be appreciated that logs 10 milled in accordance with the process of the present invention vary in vertical dimension between the upper and lower surfaces 16 and 18, but the bottom surfaces 42 and 44 of the grooves 34 and 36 are parallel and thus the distance between the bottom surfaces 42 and 44 is consistent along the length of the log 10. As a result, logs milled in accordance with the process of the present invention can be readily incorporated into a log structure with the spacing blocks 38 disposed therebetween, and with their centerlines substantially parallel. However, the variation in vertical dimension can be visually perceived, and gives the resulting structure the appearance of a traditional log structure.

Figure 10:
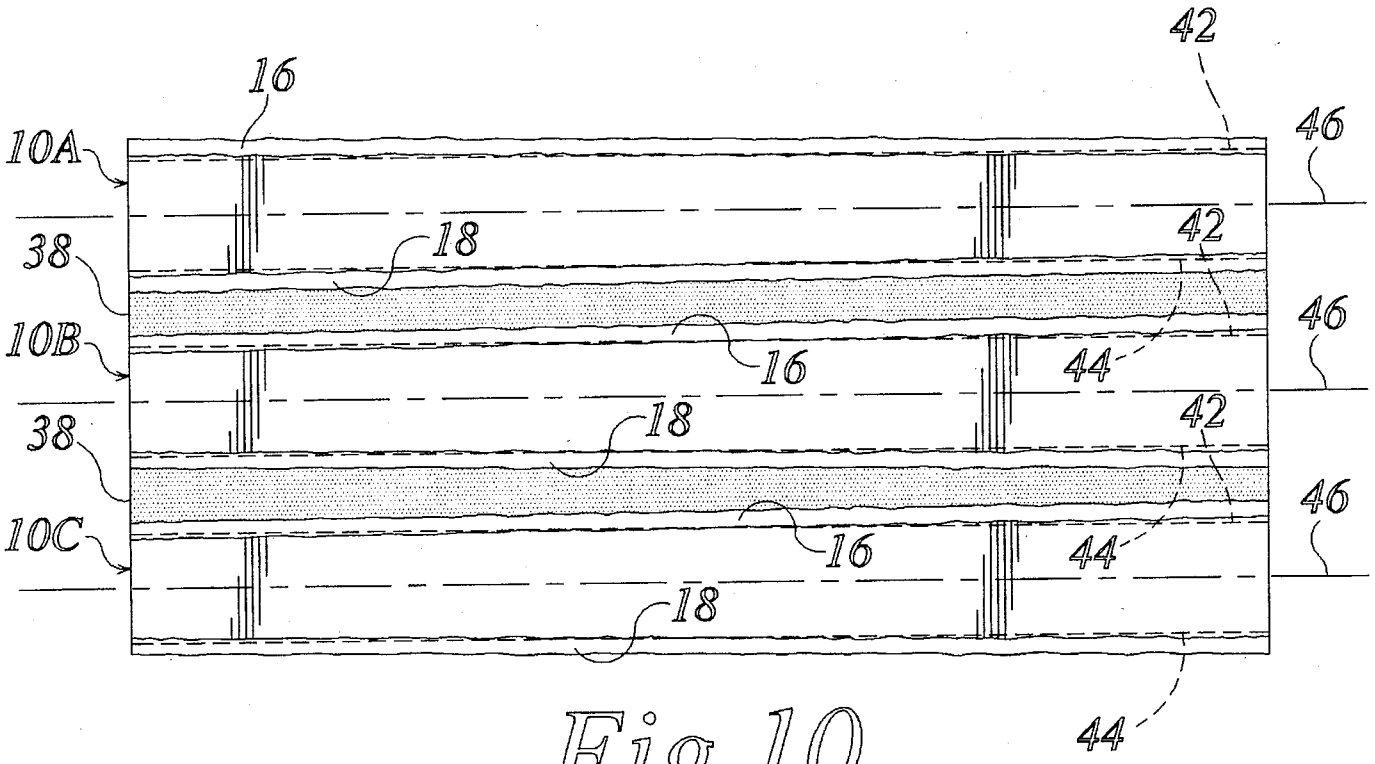
FIG. 10 illustrates a front elevation view of the logs of the present invention as they would be incorporated into the wall of a log structure.
Figure 9:
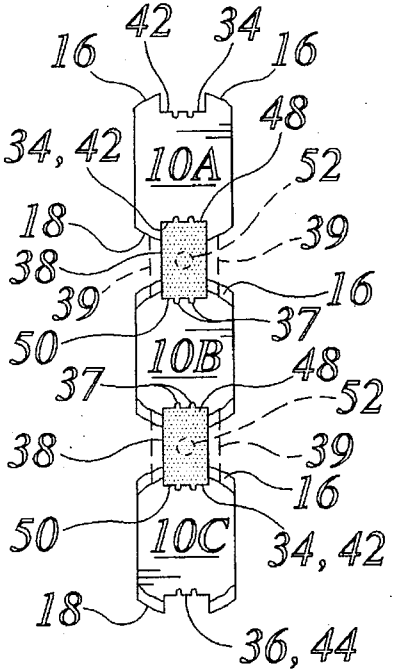
FIG. 9 illustrates an end view of the logs of the present invention as they would be incorporated into the wall of a log structure.

For example, in FIGS. 9 and 10 logs milled in accordance with the milling process of the present invention are illustrated at 10A, 10B and 10C as they would be incorporated into the wall of a log structure. As illustrated, the spacing blocks 38 define upper and lower portions 48 and 50 which are configured to be closely received in the lower and upper grooves 36 and 34, respectively, of the logs 10. Accordingly, the spacing blocks 38 serve to hold the logs 10A–C in selectively spaced disposition. As illustrated in FIG. 9, the exposed surface of the spacing blocks 38 can be covered with a conventional chinking material 39, preferably protected by a coating of sealant, thereby giving the appearance that clay or mud has been packed between the logs as in traditional log structures. In view of the fact that the varying vertical dimension between the unmilled portions of the upper and lower surfaces 16 and 18 have been retained, the resulting wall structure gives the appearance of traditional log construction wherein the logs are of inconsistent vertical dimension and the chinking joint between the logs varies in width. However, notwithstanding the traditional appearance, the center lines 46 of the logs 10A–C and the surfaces 42 and 44 are in substantially parallel alignment to facilitate ease of construction and stability in the resulting wall structure.

Figure 8A:
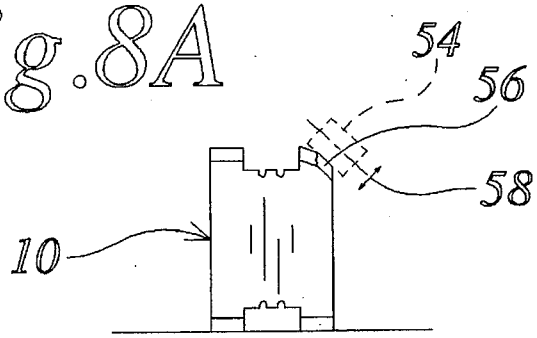
FIG. 8A illustrates an end view of a log during the optional step of cutting away selected portions of the log to produce irregular corner surfaces.
Figure 8:
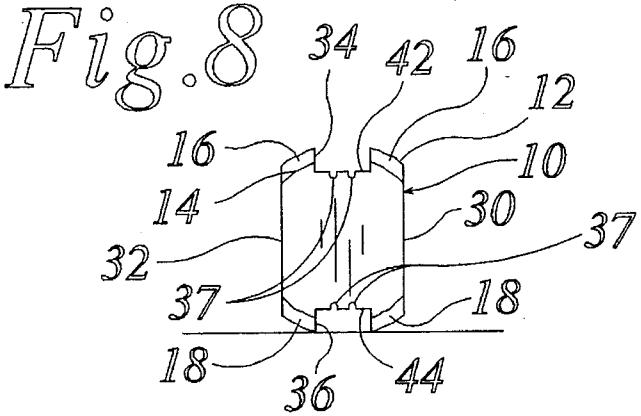
FIG. 8 illustrates an end view of a log after a longitudinal grooves have been cut in the upper and lower surfaces of the log in accordance with the log fabricating process of the present invention.

Referring now to FIG. 8A, the method of the present invention also includes the optional step of cutting away selected portions of the corners of the log 10. In this regard, where the log being process defines a rectangular cross-section or otherwise does not define the irregular corner surfaces of a log used in traditional log construction, a cutting device 54 is used to cut away portions of the corners of the log 10 to produce irregular corner surfaces 56. In the preferred application of the process the irregularity of the surface is accomplished by varying the depth of cut by selectively reciprocating the cutting device in the directions illustrated by arrow 58.

It is noted that both the logs 10 and the blocks 38 are preferably treated with conventional preservatives. It will also be noted that the spacing blocks 38 can be fabricated of a material having a high thermal resistance rating, and preferably caulking and/or sealant impregnated tape, and/or other sealant is received between the blocks 38 and logs 10. Further, as illustrated in FIG. 9, the spacing blocks 38 can be provided with conduits 52 extending therethrough to accommodate electrical or other components.

In light of the above it will be recognized that the present invention provides a log fabricating process and log for use in the construction of log structures having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A log for use in the construction of log structures and for receiving spacing members for interlocking a plurality of said logs in a log structure, said log comprising an elongated body having upper and lower surfaces and defining varying vertical dimensions along the length of said body between said upper and lower surfaces, said body being provided with a longitudinally oriented first groove in said upper surface of said body for receiving a portion of the spacing member, and a longitudinally oriented second groove in said lower surface of said body for receiving a portion of the spacing member, said first groove having a bottom surface and said second groove having a bottom surface substantially parallel to said bottom surface of said first groove, whereby the vertical dimension between said bottom surface of said first groove and said bottom surface of said second groove is substantially consistent along the lengths of said first and second grooves.

2. The log of claim 1 wherein said elongated body includes a first side which defines a side surface which is at least roughly planar.

3. The log of claim 2 wherein said elongated body includes a second side which defines a further side surface which is at least roughly planar.

4. The log of claim 1 wherein said first longitudinal groove defines a rectilinear cross-section and said bottom surface of said first longitudinal groove defines a substantially planar surface.

5. The log of claim 4 wherein said second longitudinal groove defines a rectilinear cross-section and said further bottom surface of said second longitudinal groove defines a substantially planar surface disposed substantially parallel to said bottom surface of said first longitudinal groove.

6. The log of claim 5 wherein said bottom surface of said first longitudinal groove and said further bottom surface of said second longitudinal groove are substantially parallel to the longitudinal axis of said elongated body.

* * * * *